US009233744B2

(12) United States Patent
Clever et al.

(10) Patent No.: US 9,233,744 B2
(45) Date of Patent: Jan. 12, 2016

(54) ENGINE CONTROL SYSTEM AND METHOD FOR A MARINE VESSEL

(75) Inventors: Timothy J. Clever, Waterford, MI (US); Kevin A. Cansiani, St. Clair Shores, MI (US); Martin Payne, Spring Lake, MI (US); Christopher A. Koches, Muskegon, MI (US); Ronald E. Gaskins, Kokomo, IN (US); Lance Norris, Bonney Lake, WA (US)

(73) Assignees: GM GLOBAL TECHNOLOGY OPERATIONS LLC, Detroit, MI (US); MEDALLION INSTRUMENTATION SYSTEMS LLC, Spring Lake, MI (US)

( * ) Notice: Subject to any disclaimer, the term of this patent is extended or adjusted under 35 U.S.C. 154(b) by 739 days.

(21) Appl. No.: 13/276,817

(22) Filed: Oct. 19, 2011

(65) Prior Publication Data

US 2012/0191277 A1 Jul. 26, 2012

Related U.S. Application Data

(60) Provisional application No. 61/434,563, filed on Jan. 20, 2011.

(51) Int. Cl.

| | |
|---|---|
| ***B63H 21/21*** | (2006.01) |
| ***F02B 61/04*** | (2006.01) |
| ***B63H 20/10*** | (2006.01) |
| ***B63H 21/22*** | (2006.01) |
| ***B63B 35/73*** | (2006.01) |

(52) U.S. Cl.

CPC ..... *B63H 21/21* (2013.01); *B63B 35/731* (2013.01); *B63H 20/10* (2013.01); *B63H 21/213* (2013.01); *B63H 21/22* (2013.01); *F02B 61/045* (2013.01)

(58) Field of Classification Search

CPC ..... B63H 21/213; B63H 21/22; B63H 20/10; B63H 21/21; B63B 35/731; F02B 61/045

USPC ..... 440/1, 2, 87, 84; 702/187, 127, 189; 701/21; 123/399, 339.19, 339.14, 123/90.11, 336; 114/253; 180/170; 360/6, 360/53; 379/69

See application file for complete search history.

(56) References Cited

U.S. PATENT DOCUMENTS

| | | | | |
|---|---|---|---|---|
| 4,691,677 | A | 9/1987 | Hotate et al. | |
| 4,763,264 | A | 8/1988 | Okuno et al. | |
| 4,919,096 | A | 4/1990 | Manaka et al. | |
| 5,074,810 | A * | 12/1991 | Hobbs et al. | 440/2 |
| 5,110,310 | A * | 5/1992 | Hobbs | 440/1 |

(Continued)

OTHER PUBLICATIONS

"Simple Digital systems engine map examples"; waybackmachine (http://web.archive.org/web/20001117173300/http://www.sdsefi.com/techmap.htm); posted Nov. 17, 2000; retrieved Aug. 21, 2013.*

(Continued)

*Primary Examiner* — John Q Nguyen
*Assistant Examiner* — Michael Kerrigan

(57) ABSTRACT

A system according to the principles of the present disclosure includes a profile storage module, a profile playback module, and a speed control module. The profile storage module stores an acceleration profile specifying a manner of accelerating a marine vessel. The profile playback module, in response to a play command received from a vessel operator, retrieves the acceleration profile and adjusts a desired engine speed based on the acceleration profile. The speed control module controls an engine speed of the marine vessel based on the desired engine speed.

20 Claims, 5 Drawing Sheets

(56) References Cited

U.S. PATENT DOCUMENTS

| | | | | |
|---|---|---|---|---|
| 5,477,826 | A | 12/1995 | Hara et al. | |
| 5,700,171 | A * | 12/1997 | Horton | 440/87 |
| 5,765,528 | A * | 6/1998 | Kamimaru | 123/339.19 |
| 6,109,986 | A * | 8/2000 | Gaynor et al. | 440/87 |
| 6,485,341 | B1 * | 11/2002 | Lanyi et al. | 440/87 |
| 6,672,282 | B2 * | 1/2004 | Harrison et al. | 123/399 |
| 6,757,606 | B1 | 6/2004 | Gonring | |
| 7,214,110 | B1 * | 5/2007 | Ehlers et al. | 440/1 |
| 7,361,067 | B1 * | 4/2008 | Smedema | 440/1 |
| 7,877,174 | B2 * | 1/2011 | Walser et al. | 701/21 |
| 2002/0157639 | A1 | 10/2002 | Kidokoro et al. | |
| 2004/0153286 | A1 | 8/2004 | Yamada | |
| 2005/0121005 | A1 | 6/2005 | Edwards | |
| 2007/0233430 | A1 * | 10/2007 | Singh | 702/187 |
| 2008/0028387 | A1 | 1/2008 | Nakagawa et al. | |
| 2009/0215331 | A1 | 8/2009 | Suzuki et al. | |
| 2009/0229568 | A1 | 9/2009 | Nakagawa | |
| 2010/0152990 | A1 | 6/2010 | Bjernetun et al. | |
| 2012/0191275 | A1 | 7/2012 | Clever et al. | |
| 2012/0191276 | A1 | 7/2012 | Clever et al. | |

OTHER PUBLICATIONS

Gina Trapani, "How to use MD5 sums to verify downloaded files", Mar. 27, 2007, www.lifehacker.com/247262/how-to-use-md5-sums-to-verify-downloaded-files.

* cited by examiner

ENGINE CONTROL SYSTEM AND METHOD FOR A MARINE VESSEL

CROSS-REFERENCE TO RELATED APPLICATIONS

This application claims the benefit of U.S. Provisional Application No. 61/434,563, filed on Jan. 20, 2011. The disclosure of the above application is incorporated herein by reference in its entirety.

FIELD

The present disclosure relates to engine control systems and methods for controlling a vessel speed of a marine vessel during and after an acceleration launch.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

In some marine activities, such as skiing and wakeboarding, a participant may prefer a certain acceleration profile when launching a marine vessel to a cruise speed. Some marine vessels include engine control systems that control the vessel speed when a measured speed is greater than or equal to a cruise speed. However, traditional engine control systems do not control the vessel speed during launch, and therefore an operator must control the vessel speed until a cruise speed is achieved. This may lead to inconsistent launch acceleration and/or overshooting of the cruise speed.

SUMMARY

A system according to the principles of the present disclosure includes a profile storage module, a profile playback module, and a speed control module. The profile storage module stores an acceleration profile specifying a manner of accelerating a marine vessel. The profile playback module, in response to a play command received from a vessel operator, retrieves the acceleration profile and adjusts a desired engine speed based on the acceleration profile. The speed control module controls an engine speed of the marine vessel based on the desired engine speed.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1:
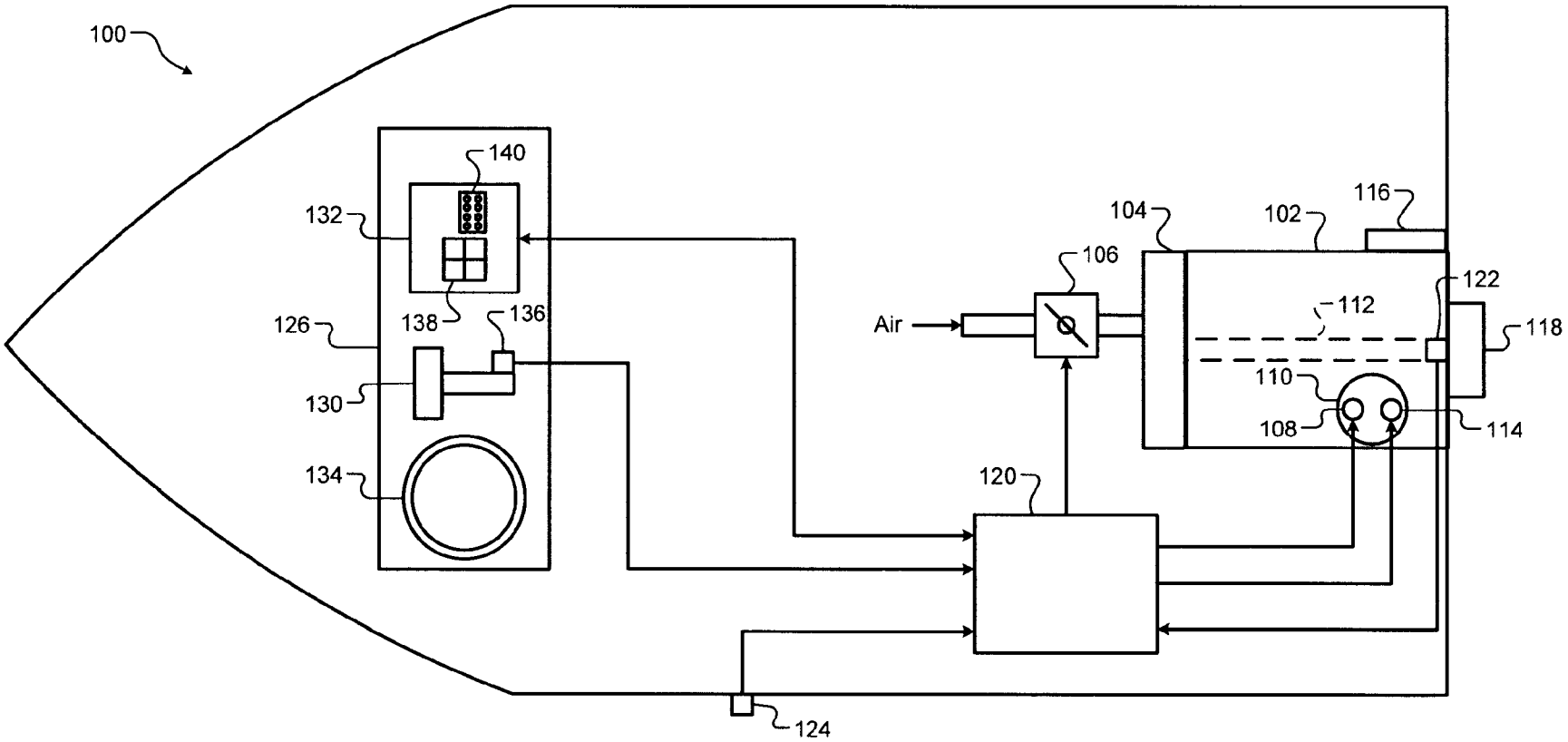
FIG. 1 is a functional block diagram of a marine vessel including an example engine control system according to the principles of the present disclosure.

The following description is merely illustrative in nature and is in no way intended to limit the disclosure, its application, or uses. For purposes of clarity, the same reference numbers will be used in the drawings to identify similar elements. As used herein, the phrase at least one of A, B, and C should be construed to mean a logical (A or B or C), using a non-exclusive logical or. It should be understood that steps within a method may be executed in different order without altering the principles of the present disclosure.

As used herein, the term module may refer to, be part of, or include an Application Specific Integrated Circuit (ASIC); an electronic circuit; a combinational logic circuit; a field programmable gate array (FPGA); a processor (shared, dedicated, or group) that executes code; other suitable components that provide the described functionality; or a combination of some or all of the above, such as in a system-on-chip. The term module may include memory (shared, dedicated, or group) that stores code executed by the processor.

The term code, as used above, may include software, firmware, and/or microcode, and may refer to programs, routines, functions, classes, and/or objects. The term shared, as used above, means that some or all code from multiple modules may be executed using a single (shared) processor. In addition, some or all code from multiple modules may be stored by a single (shared) memory. The term group, as used above, means that some or all code from a single module may be executed using a group of processors. In addition, some or all code from a single module may be stored using a group of memories.

The apparatuses and methods described herein may be implemented by one or more computer programs executed by one or more processors. The computer programs include processor-executable instructions that are stored on a non-transitory tangible computer readable medium. The computer programs may also include stored data. Non-limiting examples of the non-transitory tangible computer readable medium are nonvolatile memory, magnetic storage, and optical storage.

An engine control system and method according to the present disclosure enables an operator of a marine vessel to record an acceleration profile, store an acceleration profile in memory, and replay a stored profile. An acceleration profile specifies a manner of accelerating a marine vessel, such as engine or vessel speeds with respect to time. The stored profile may be a profile recorded by the operator, a default profile stored by a manufacturer, or a profile downloaded or received from an external device such as a flash drive or a wireless source. Thus, an operator may replay an ideal profile and eliminate inconsistent launches and cruise speed overshoots.

Referring now to FIG. 1, a functional block diagram of an example marine vessel 100 is presented. Although the marine vessel 100 is depicted as a boat, the marine vessel 100 may be any type of watercraft such as a boat or a jet ski. The marine vessel 100 includes an engine 102 that propels the marine vessel 100. While the engine 102 is shown and will be discussed as a spark-ignition internal combustion engine (ICE), the engine 102 may be another type of engine, such as a compression-ignition ICE. In addition, the marine vessel 100 may include multiple engines.

Air is drawn into the engine 102 through an intake manifold 104. Airflow into the engine 102 may be varied using a throttle valve 106. One or more fuel injectors, such as a fuel injector 108, mix fuel with the air to form an air/fuel mixture. The air/fuel mixture is combusted within cylinders of the engine 102, such as a cylinder 110. Although the engine 102 is depicted as including one cylinder, the engine 102 may include more than one cylinder.

The cylinder 110 includes a piston (not shown) that is mechanically linked to a crankshaft 112. One combustion cycle within the cylinder 110 may include four phases: an intake phase, a compression phase, a combustion (or expansion) phase, and an exhaust phase. During the intake phase, the piston moves toward a bottommost position and draws air into the cylinder 110. During the compression phase, the piston moves toward a topmost position and compresses the air or air/fuel mixture within the cylinder 110.

During the combustion phase, spark from a spark plug 114 ignites the air/fuel mixture. The combustion of the air/fuel mixture drives the piston back toward the bottommost position, and the piston drives rotation of the crankshaft 112. Resulting exhaust gas is expelled from the cylinder 110 through an exhaust manifold 116 to complete the exhaust phase and the combustion event. A propeller 118 is coupled to and rotates with the crankshaft 112. The propeller 118 imparts momentum to water, which causes a propulsion force to act on the marine vessel 100.

An engine control module (ECM) 120 controls the speed of the engine 102 by adjusting the position of the throttle 106, the timing or pulse width of the injector 108, and the timing of the spark plug 114. A crankshaft position sensor 122 outputs a crankshaft position signal based on rotation of the crankshaft 112. The ECM 120 uses the crankshaft position signal to determine the rotational speed of the crankshaft 112 (e.g., in revolutions per minute or RPM), which may be referred to as the engine speed.

A vessel speed sensor 124 outputs a vessel speed signal based on the speed of the marine vessel 100. The ECM 120 uses the vessel speed signal to determine the speed of the marine vessel 100 (e.g., in miles per hour and/or in kilometers per hour), which may be referred to as the vessel speed. The vessel speed sensor 124 may be a paddlewheel sensor, a pressure sensor, or an ion sensor, and may be mounted to an outside surface of the marine vessel 100, such as to the bottom of the hull. Alternatively, the vessel speed sensor 124 may be a global positioning system (GPS), and may be mounted in the passenger compartment of the marine vessel 100.

A vessel instrument panel 126 includes an accelerator lever 130 and an operator interface device (OID) 132. The vessel instrument panel 126 may also include a steering wheel 134. The operator manipulates the accelerator lever 130 to adjust the vessel speed. A lever position sensor 136 outputs a lever position signal based on the position of the accelerator lever 130. The ECM 120 uses the lever position signal to determine the position of the accelerator lever 130, which may be referred to as the lever position. The ECM 120 controls the engine speed based on the lever position.

The operator manipulates the OID 132 to record an acceleration profile, to replay a stored profile, and to upload or download a stored profile. The OID 132 may include one or more buttons (or a touch screen) 138 that the operator presses to perform these operations. The operator may upload a stored profile from the ECM 120 to the OID 132 or from the OID 132 to an external device (not shown), such as a flash drive or a wireless source, via a port (or wireless interface) 140. The operator may download a stored profile from the OID 132 to the ECM 120 or from the external device to the OID 132. The ECM 120 records the engine speed, controls the engine speed, and uploads or downloads stored profiles based on inputs received from the OID 132. The ECM 120, the OID 132, and the external device may communicate via serial communication.

Figure 2:
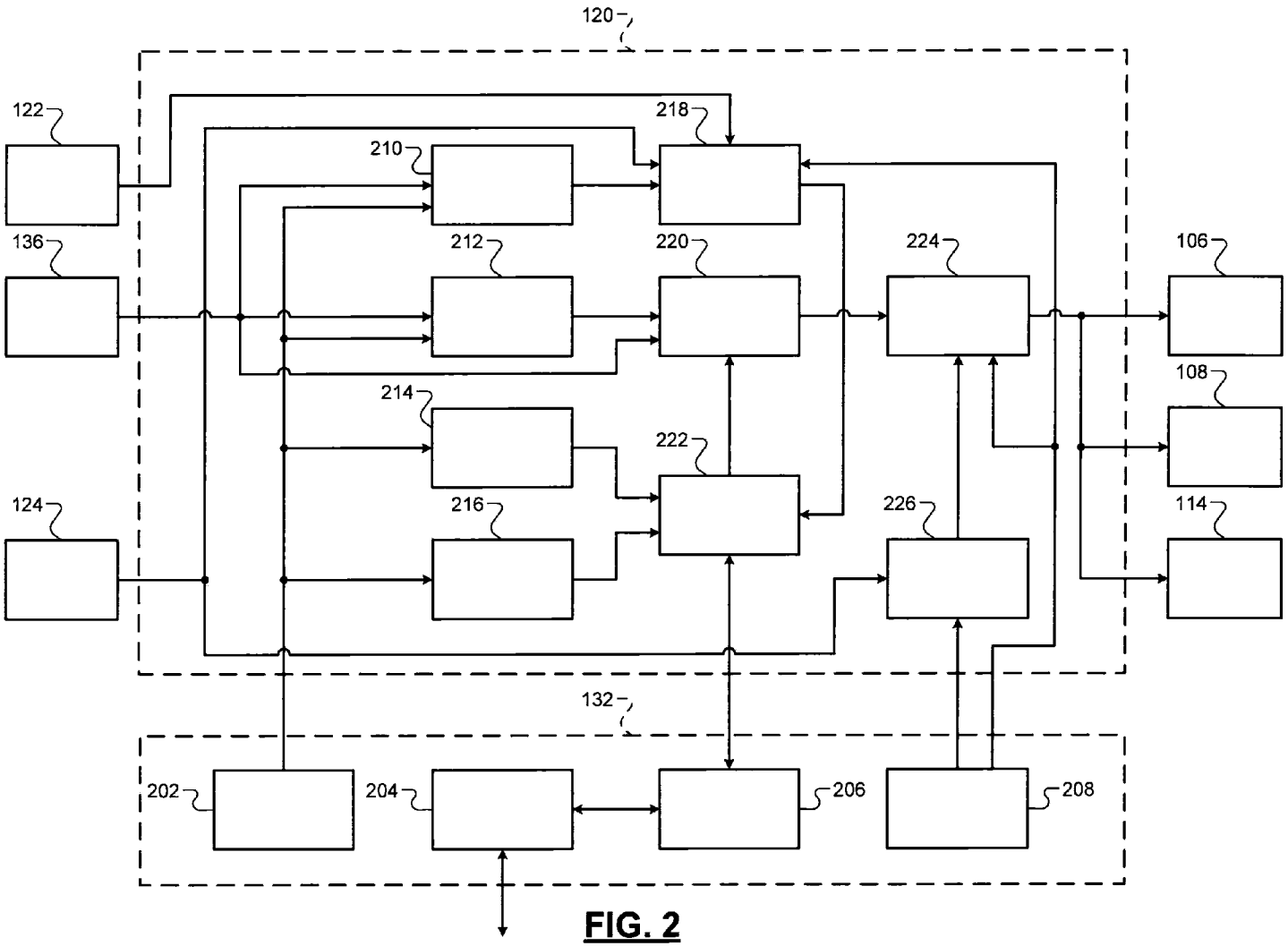
FIG. 2 is a functional block diagram of the engine control system of FIG. 1.

Referring now to FIG. 2, the OID 132 includes a command determination module 202, an external device module 204, a profile storage module 206, and a cruise speed module 208. The command determination module 202 determines whether the operator has given a command to the OID 132, and if so, which command has been given to the OID 132. Commands given to the OID 132 may include a record command, a play command, an upload command, and a download command.

The external device module 204 communicates with the external device via, for example, the port 140. The profile storage module 206 stores one or more acceleration profiles, which may collectively be referred to as a profile library, in non-volatile memory. The cruise speed module 208 determines a cruise speed based on an input received from the operator via, for example, the buttons 138.

The ECM 120 includes a recording activation module 210, a playback activation module 212, a profile upload module 214, and a profile download module 216. The command determination module 202 outputs commands to these modules.

The recording activation module 210 receives the record command from the command determination module 202 and receives the lever position from the lever position sensor 136. The recording activation module 210 may enable a record mode when the record command is received from the command determination module 202. The recording activation module 210 may activate recording when the record mode is enabled for less than a first period and a difference in the lever position from an initial position to a subsequent position is greater than a first difference. The first period may be predetermined. For example only, the first period may be a range (e.g., between 30 seconds (s) and 100 s) or a specific value (e.g., 60 s). The first difference may be predetermined. For example only, the first difference may be a range (e.g., between 2.5 percent (%) and 10%) or a specific value (e.g., 5%).

A profile record module 218 receives inputs from the crankshaft position sensor 122 and the recording activation module 210, and records the engine speed when recording is activated. The profile record module 218 may record the engine speed for a second period. The second period may be predetermined or determined by the operator. For example only, the second period may be a range (e.g., between 5 s and 30 s) or a specific value (e.g., 10 s). The profile record module 218 may receive the vessel speed from the vessel speed sensor 124 and receive the cruise speed from the cruise speed module 208, and may record the engine speed until the vessel speed is greater than or equal to the cruise speed.

The playback activation module 212 receives the play command from the command determination module 202 and receives the lever position from the lever position sensor 136. The playback activation module 212 may enable a playback mode when the play command is received from the command determination module 202. The playback activation module 212 may activate playback when the record mode is enabled for less than the first period and a difference in the lever position from an initial position to a subsequent position is greater than a second difference. The second difference may be predetermined. For example only, the second difference may be a range (e.g., between 5% and 20%) or a specific value (e.g., 10%).

A profile playback module 220 receives an input from the playback activation module 212 and plays a stored profile when playback is activated. The profile playback module 220 may retrieve the stored profile from a profile storage module 222. The profile playback module 220 plays the stored profile by outputting a desired engine speed to a speed control module 224. The profile playback module 220 receives the lever position from the lever position sensor 136, and limits the desired engine speed during a profile playback to a desired engine speed corresponding to the lever position.

The speed control module 224 controls the engine speed based on the desired engine speed received from the profile playback module 220. The speed control module 224 may also receive the cruise speed from the cruise speed module 208 and control the engine speed based on the cruise speed. The speed control module 224 controls the engine speed by outputting a desired lever position to the throttle valve 106, outputting a desired injection timing to the fuel injector 108, and outputting a desired spark timing to the spark plug 114.

The profile upload module 214 receives the upload command from the command determination module 202 and uploads a stored profile when the upload command is received. The profile upload module 214 may upload a stored profile from the ECM 120 to the OID 132 or from the OID 132 to the external device. The profile upload module 214 uploads a stored profile from the ECM 120 to the OID 132 by instructing the profile storage module 222 to upload a stored profile to the profile storage module 206.

The profile download module 216 receives the download command from the command determination module 202 and downloads a stored profile when the upload command is received. The profile download module 216 may download a stored profile from the OID 132 to the ECM 120 or from the external device to the OID 132. The profile download module 216 downloads a stored profile from the OID 132 to the ECM 120 by instructing the profile storage module 222 to download a stored profile from the profile storage module 206.

The profile storage module 222 stores one or more acceleration profiles. The profile storage module 222 may store profiles received from the profile record module 218 or the profile storage module 206. The profile storage module 206 and the profile storage module 222 may be combined and located in the ECM 120 or in the OID 132.

The ECM 120 may also include a profile transition module 226. The profile transition module 226 generates a transition profile that specifies a manner of transitioning the engine speed from the final speed of a launch profile to an engine speed that yields a vessel speed corresponding to the cruise speed. The transition profile may adjust the engine speed and/or the vessel speed at a desired rate that prevents overshooting or undershooting the cruise speed. The profile transition module 226 may receive the vessel speed from the vessel speed sensor 124 and the cruise speed from the cruise speed module 208. The profile transition module 226 outputs a desired engine speed to the speed control module 224 based on the transition profile.

Figure 3A:
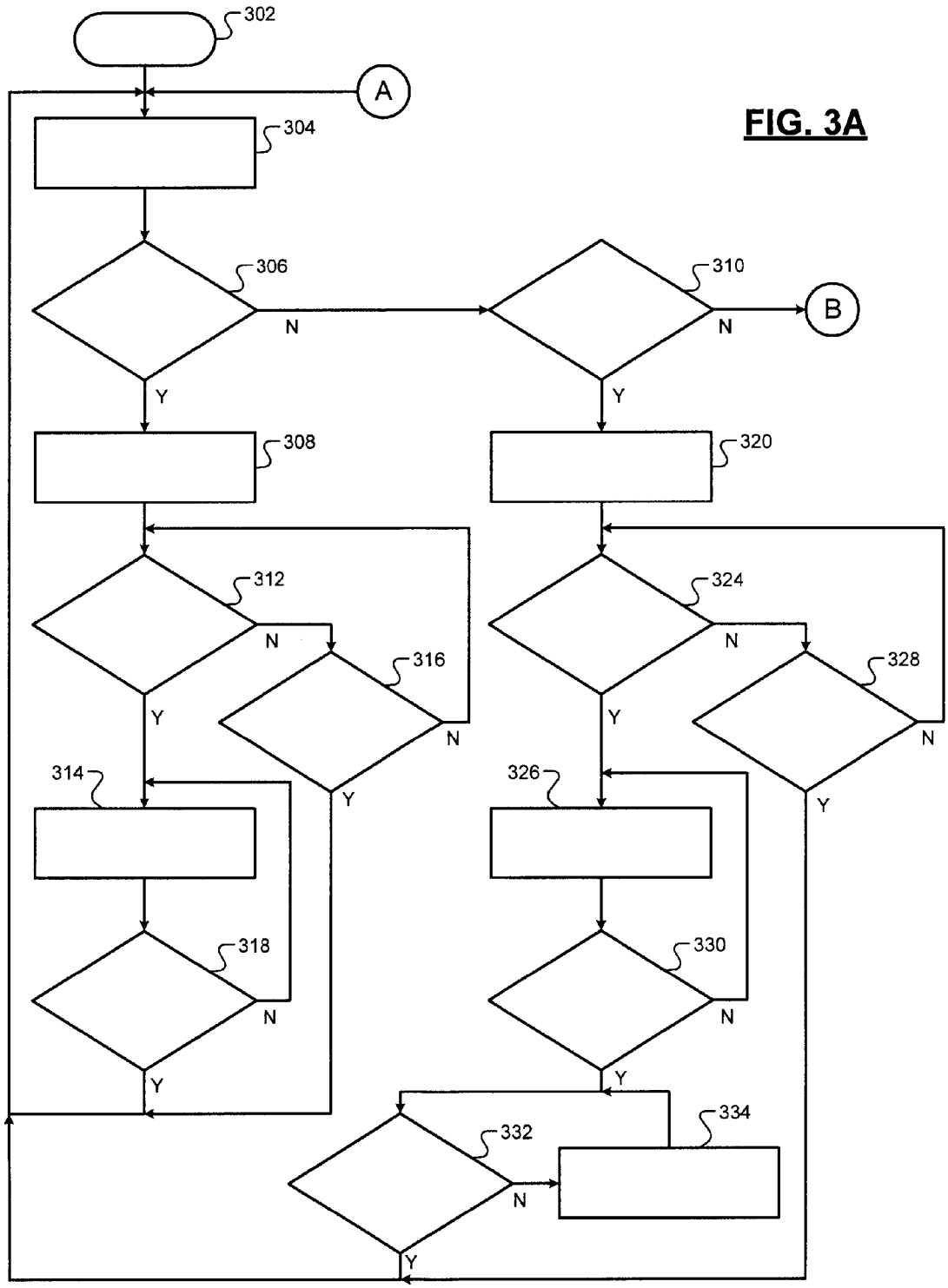
FIG. 3A is a first flowchart illustrating steps of an example engine control method according to the principles of the present disclosure.

Referring now to FIG. 3A, a method for controlling an engine in a marine vessel begins at 302. At 304, the method enables a standby mode and continues to 306. At 306, the method determines whether a record command is received. If 306 is true, the method continues at 308. Otherwise, the method continues at 310. The method may determine whether the record command, a play command, an upload command, or a download command is received based on input from a vessel operator.

At 308, the method enables a record mode and continues at 312. At 312, the method determines whether recording is activated. If 312 is true, the method continues at 314. Otherwise, the method continues at 316. The method may determine that recording is activated when a difference in a lever position from an initial position to a subsequent position is greater than a first difference. The first difference may be predetermined. For example only, the first difference may be a range (e.g., between 2.5% and 10%) or a specific value (e.g., approximately 5%).

At 316, the method determines whether an enabled period is greater than or equal to a first period. The enabled period is the period that the record mode is enabled. The first period may be predetermined. For example only, the first period may be a range (e.g., between 30 s and 100 s) or a specific value (e.g., approximately 60 s). If 316 is true, the method continues at 304. Otherwise, the method continues at 312. In this manner, the record mode may timeout when the difference in the lever position within the first period is less than the first difference.

At 314, the method records the engine speed and continues at 318. At 318, the method determines whether a recording period is greater than or equal to a second period. The second period may be predetermined or determined by the operator. For example only, the second period may be a range (e.g., between 5 s and 30 s) or a specific value (e.g., approximately 10 s). If 318 is true, the method continues at 304. Otherwise, the method continues at 314. In this manner, the method may record the engine speed as long as the recording period is less than the second period. Alternatively, the method may record the engine speed until the vessel speed is greater than or equal to a cruise speed, which may be selected by the operator. In addition, the method may record the vessel speed and/or the throttle position.

At 310, the method determines whether the play command is received. If 310 is true, the method continues at 320. Otherwise, the method continues at 322, as discussed below with reference to FIG. 3B. At 320, the method enables a playback mode and continues at 324. At 324, the method determines whether playback is activated. If 324 is true, the method continues at 326. Otherwise, the method continues at 328. The method may determine that playback is activated when a difference in the lever position from an initial position to a subsequent position is greater than a second difference. The second difference may be predetermined. For example only, the second difference may be a range (e.g., between 5% and 20%) or a specific value (e.g., approximately 10%).

At 328, the method determines whether an enabled period is greater than or equal to the first period. The enabled period is the period that the playback mode is enabled. If 328 is true, the method continues at 304. Otherwise, the method continues at 324. In this manner, the playback mode may timeout when the difference in the lever position within the first period is less than the first difference.

At 326, the method plays a launch profile and continues at 330. The method plays a launch profile by controlling the engine speed to a desired speed. The method may limit the desired speed to an engine speed corresponding to a lever position. Thus, if the operator initiates playback by adjusting the accelerator lever 130 to a lever position corresponding to an engine speed that is less than the desired speed during playback, then the desired speed may be limited to the corresponding engine speed. Additionally, the operator may end playback by pulling back on the accelerator lever 130.

At 330, the method determines whether a playback period is greater than or equal to the second period. If 330 is true, the method continues at 332. Otherwise, the method continues at 326. In this manner, the method may playback the launch profile until the playback period is equal to the second period or the recording period.

At 332, the method determines whether a vessel speed is greater than or equal to a cruise speed. If 332 is true, the method continues at 304. Otherwise, the method plays a transition profile at 334 and continues at 332. The transition profile transitions from the final engine speed during a profile playback to an engine speed yielding a vessel speed that is equal to the cruise speed. The transition profile may linearly adjust or ramp the engine speed at a desired rate, which may be predetermined.

Figure 3B:
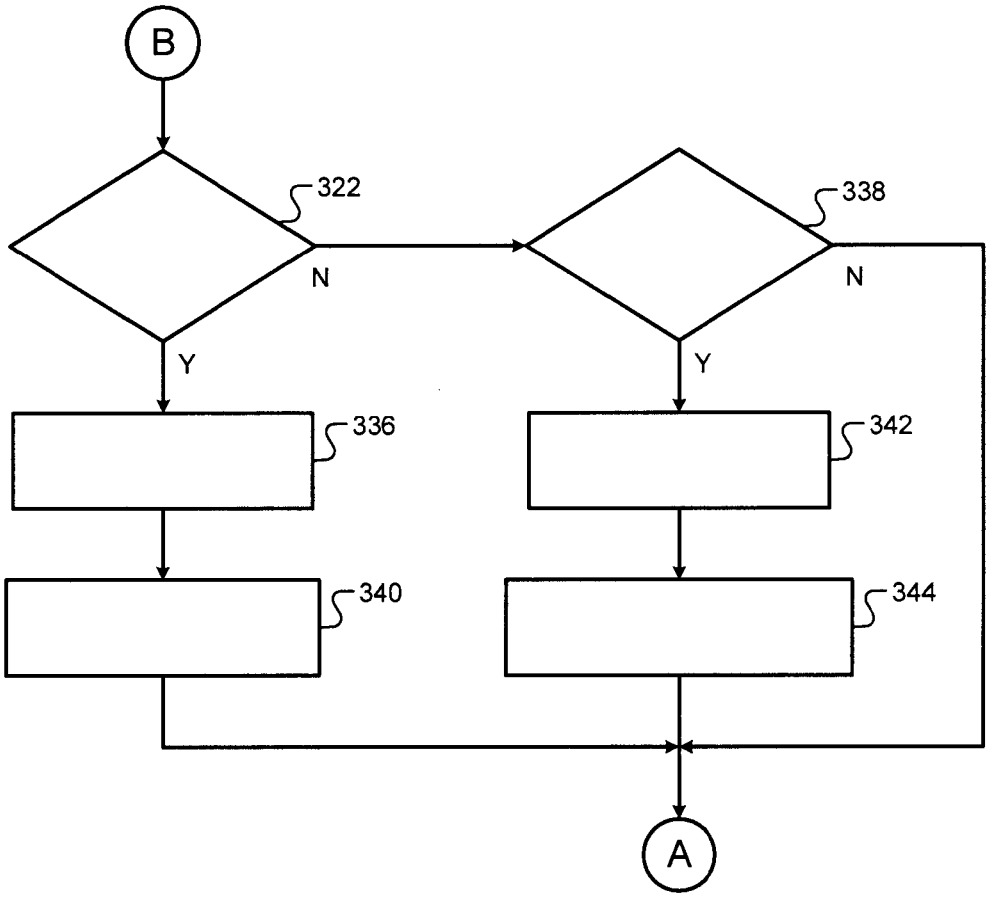
FIG. 3B is a second flowchart illustrating steps of an example engine control method according to the principles of the present disclosure.

Referring now to FIG. 3B, the method continues at 322 and determines whether the upload command is received. If 322 is true, the method continues at 336. Otherwise, the method continues at 338. At 336, the method enables an upload mode and continues at 340. At 340, the method uploads a launch profile and continues at 304, as discussed above with reference to FIG. 3A. The method may upload the launch profile from an ECM to an OID in a vessel instrument panel or from the OID to an external device, such as a flash drive or a wireless source.

At 338, the method determines whether the download command is received. If 338 is true, the method continues at 342. Otherwise, the method continues at 304. At 342, the method enables a download mode and continues at 344. At 344, the method downloads a launch profile and continues at 304. The method may download the launch profile from the OID to the ECM or from the external device to the OID.

Figure 4:
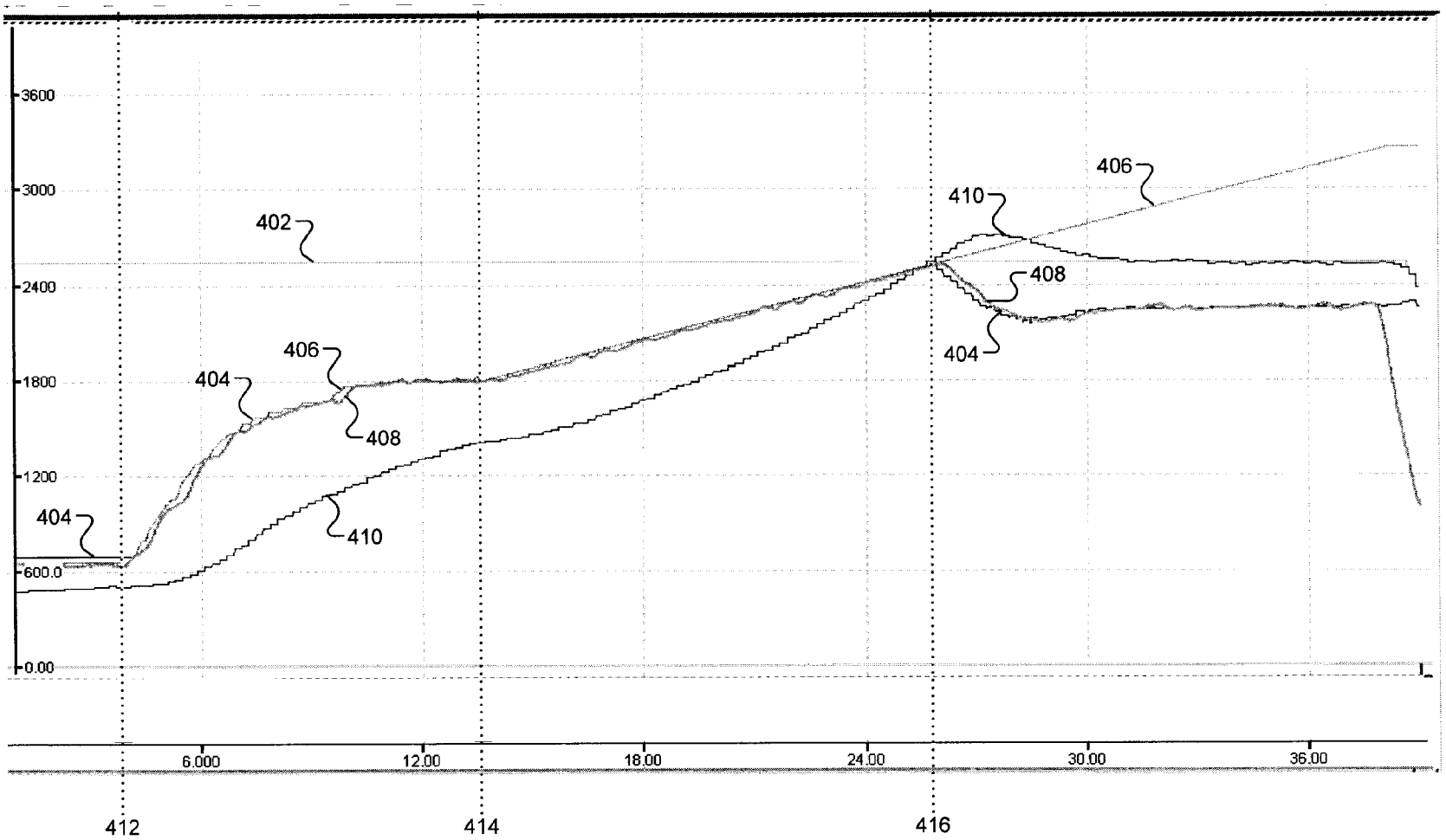
FIG. 4 is a graph illustrating example engine control signals and example vessel sensor signals according to the principles of the present disclosure.

Referring now to FIG. 4, a graph illustrates engine control signals and vessel sensor signals. The engine control signals indicate a cruise vessel speed 402, a desired engine speed 404, and a launch acceleration profile 406. The vessel sensor signals indicate a measured engine speed 408 and a measured vessel speed 410. The x-axis indicates time in s, and the y-axis indicates speed in revolutions per minute (rpm).

At 412, the desired engine speed 404 is increased to launch a marine vessel. Between 412 and 416, the desired engine speed 404 is controlled to match the launch acceleration profile 406. At 414, playback of a stored portion of the launch acceleration profile 406 ends and the launch acceleration profile 406 is increased at a desired rate. At 416, the desired engine speed 404 is controlled to minimize a difference between the cruise vessel speed 402 and the measured vessel speed 410.

The broad teachings of the disclosure can be implemented in a variety of forms. Therefore, while this disclosure includes particular examples, the true scope of the disclosure should not be so limited since other modifications will become apparent to the skilled practitioner upon a study of the drawings, the specification, and the following claims.

What is claimed is:

1. A system comprising:

a profile storage module that stores an acceleration profile specifying a manner of accelerating a marine vessel;

a profile playback module that, in response to a play command received from a vessel operator, retrieves the acceleration profile and adjusts a desired engine speed based on the acceleration profile; and a speed control module that controls an engine speed of the marine vessel based on the desired engine speed, wherein the acceleration profile includes at least one of N engine speeds and N vessel speeds, and N is an integer greater than one; and at least one of:

a profile upload module that uploads the acceleration profile to at least one of an operator interface device and a network device in response to an upload command received from the vessel operator; and a profile download module that downloads the acceleration profile from at least one of the operator interface device and the network device in response to a download command received from the vessel operator.

2. The system of claim 1 wherein the system includes the profile upload module.

3. The system of claim 1 wherein the system includes the profile download module.

4. The system of claim 1 further comprising a profile transition module that generates a transition profile specifying a manner of transitioning the marine vessel from a final speed of the acceleration profile to a desired cruise speed, wherein the speed control module controls the engine speed based on the transition profile.

5. The system of claim 1 further comprising a profile record module that records the acceleration profile in response to a record command received from the vessel operator.

6. The system of claim 5 further comprising a recording activation module that activates recording when a difference in a position of an accelerator lever from a first position to a second position is greater than a first difference during a first period that begins when the record command is received from the vessel operator.

7. The system of claim 6 wherein the profile record module records the engine speed for a second period when the recording activation module activates recording.

8. The system of claim 1 further comprising a playback activation module that activates playback when a difference in a position of an accelerator lever from a first position to a second position is greater than a first difference during a first period that begins when the play command is received from the vessel operator.

9. The system of claim 8 wherein the speed control module controls the engine speed based on the acceleration profile when the playback activation module activates playback.

10. A method comprising:

storing an acceleration profile specifying a manner of accelerating a marine vessel;

retrieving the acceleration profile in response to a play command received from a vessel operator;

adjusting a desired engine speed based on the acceleration profile in response to said play command;

controlling an engine speed of the marine vessel based on the desired engine speed, wherein the acceleration profile includes at least one of N engine speeds and N vessel speeds, and N is an integer greater than one; and at least one of:

uploading the acceleration profile to at least one of an operator interface device and a network device in response to an upload command received from the vessel operator; and downloading the acceleration profile from at least one of the operator interface device and the network device in response to a download command received from the vessel operator.

11. The method of claim 10 wherein the method includes uploading the acceleration profile to at least one of the operator interface device and the network device in response to the upload command received from the vessel operator.

12. The method of claim 11 wherein the network device includes a flash drive.

13. The method of claim 10 wherein the method includes downloading the acceleration profile from at least one of the operator interface device and the network device in response to the download command received from the vessel operator.

14. The method of claim 13 wherein the network device includes a flash drive.

15. The method of claim 10 further comprising:

generating a transition profile specifying a manner of transitioning the marine vessel from a final speed of the acceleration profile to a desired cruise speed; and controlling the engine speed based on the transition profile.

16. The method of claim 10 further comprising recording the acceleration profile in response to a record command received from the vessel operator.

17. The method of claim 16 further comprising activating recording when a difference in a position of an accelerator lever from a first position to a second position is greater than a first difference during a first period that begins when the record command is received from the vessel operator.

18. The method of claim 17 further comprising recording the engine speed for a second period when recording is activated.

19. The method of claim 10 further comprising activating playback when a difference in a position of an accelerator lever from a first position to a second position is greater than a first difference during a first period that begins when the play command is received from the vessel operator.

20. The method of claim 19 further comprising controlling the engine speed based on the acceleration profile when playback is activated.

* * * * *